US007894742B2

(12) United States Patent
Kouzu

(10) Patent No.: US 7,894,742 B2
(45) Date of Patent: Feb. 22, 2011

(54) WASTE DEVELOPER COLLECTING METHOD FOR IMAGE FORMING APPARATUS

(75) Inventor: Norio Kouzu, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 177 days.

(21) Appl. No.: 12/207,431

(22) Filed: Sep. 9, 2008

(65) Prior Publication Data

US 2009/0074470 A1 Mar. 19, 2009

Related U.S. Application Data

(60) Provisional application No. 60/971,235, filed on Sep. 10, 2007, provisional application No. 60/972,239, filed on Sep. 13, 2007.

(51) Int. Cl.
*G03G 15/16* (2006.01)
*G03G 21/12* (2006.01)

(52) U.S. Cl. ..... 399/101; 399/360

(58) Field of Classification Search ..... 399/101, 399/360, 254, 256, 257, 358
See application file for complete search history.

(56) References Cited

U.S. PATENT DOCUMENTS

| | | | | |
|---|---|---|---|---|
| 6,014,541 | A * | 1/2000 | Kato et al. | 399/358 |
| 7,099,617 | B2 * | 8/2006 | Jeong et al. | 399/358 |
| 7,251,433 | B2 * | 7/2007 | Ai et al. | 399/101 |
| 7,577,383 | B2 * | 8/2009 | Brown et al. | 399/256 |
| 2007/0189811 | A1 * | 8/2007 | Sato | 399/254 |

FOREIGN PATENT DOCUMENTS

JP 2005-049677 2/2005

* cited by examiner

*Primary Examiner*—Sandra L Brase
(74) *Attorney, Agent, or Firm*—Patterson & Sheridan, LLP

(57) ABSTRACT

An image forming apparatus includes a horizontal carrying mechanism that collects a waste developer in the horizontal direction, relay carrying mechanisms that carry the waste developer collected by the horizontal carrying mechanism to a desired position, a vertical carrying mechanism that carries the waste developer, which is carried by the relay carrying mechanisms, in the vertical upward direction, and a relay carrying mechanism that feeds the waste developer carried by the vertical carrying mechanism into a storage case. A waste developer flow rate of a waste-developer carrying mechanism at a post stage is equal to or larger than a waste developer flow rate of a waste-developer carrying mechanism at a pre-stage thereof.

21 Claims, 8 Drawing Sheets

WASTE DEVELOPER COLLECTING METHOD FOR IMAGE FORMING APPARATUS

CROSS-REFERENCE TO RELATED APPLICATION

This application is based upon and claims the benefits of priorities from U.S. Provisional Application Ser. No. 60/971,235 filed on Sep. 10, 2007 and U.S. Provisional Application Ser. No. 60/972,239 filed on Sep. 13, 2007, the entire contents of which are incorporated herein by reference.

TECHNICAL FIELD

The present invention relates to image forming apparatuses such as a copying machine and a printer, and, more particularly to an image forming apparatus including a waste-toner carrying mechanism that realizes space-saving and a waste developer collecting method for the image forming apparatus.

BACKGROUND

An image forming apparatus includes a secondary transfer roller in order to bring an image bearing member such as a transfer belt and a recording medium into press-contact with each other and transfer an image onto the recording medium.

When the recording medium is conveyed to the secondary transfer roller at predetermined timing, a toner does not adhere to the secondary transfer roller. However, if the recording medium is not conveyed at the predetermined timing, for example, when a jam of the recording medium occurs, a toner carried on the image bearing member adheres to the secondary transfer roller. In this case, when the next recording medium is conveyed to the secondary transfer roller, the toner adheres to the rear surface of the sheet and pollution occurs.

In order to prevent the pollution, the image forming apparatus has a mechanism that brings a cleaning member into contact with the secondary transfer roller to scrape off the adhering toner. A carrying mechanism carries a waste toner scraped off by the mechanism to a tank for storing the waste toner.

The tank for storing the waste toner needs to have a certain appropriate size. Therefore, a layout of the tank is limited in terms of the size. In other words, a degree of freedom of an arrangement of the tank is limited because of a relation between the tank and other components of the image forming apparatus.

In order to reduce a size of the image forming apparatus under such a limitation, the carrying mechanism that carries the waste toner to the tank is desirably more space-saving. In particular, when an opening of the tank is set higher than a position of the cleaning member, a mechanism that carries the waste toner upward is necessary.

Concerning this point, a carrying mechanism that rotationally moves a belt, which has teeth and is inclined, to thereby carry a waste toner accumulated in the teeth upward is proposed (see, for example, JP-A-2005-49677).

However, this technique has a problem in that it is difficult to use spaces above and below the carrying mechanism because the carrying mechanism tilts and, as a result, desired space-saving cannot be attained.

SUMMARY

It is an object of the present invention to provide an image forming apparatus including a waste-toner carrying mechanism that realizes space-saving and a waste developer collecting method for the image forming apparatus.

In an aspect of the present invention, an image forming apparatus includes a recording-medium feeding mechanism that feeds recording media one by one, a recording-medium conveying path to convey the recording medium fed by the recording-medium feeding mechanism to a recording-medium discharge section, an image forming unit that is arranged further on an upstream side than the recording-medium discharge section of the recording-medium conveying path and executes an image forming process to print an image based on image data on the recording medium conveyed through the recording-medium conveying path, a first carrying mechanism that receives a waste developer collected from a secondary transfer roller of the image forming unit and carries the waste developer to one end thereof, and a second carrying mechanism that receives the waste developer carried by the first carrying mechanism and carries the waste developer in a vertical upward direction to a position higher than the first carrying mechanism.

DETAILED DESCRIPTION

Throughout this description, the embodiments and examples shown should be considered as exemplars, rather than limitations on the apparatus and methods of the present invention.

An image forming apparatus including a waste-toner carrying mechanism that realizes space-saving (hereinafter referred to as image forming apparatus) according to an embodiment of the present invention is explained in detail below with reference to the accompanying drawings.

Overview of the Image Forming Apparatus

Figure 10:
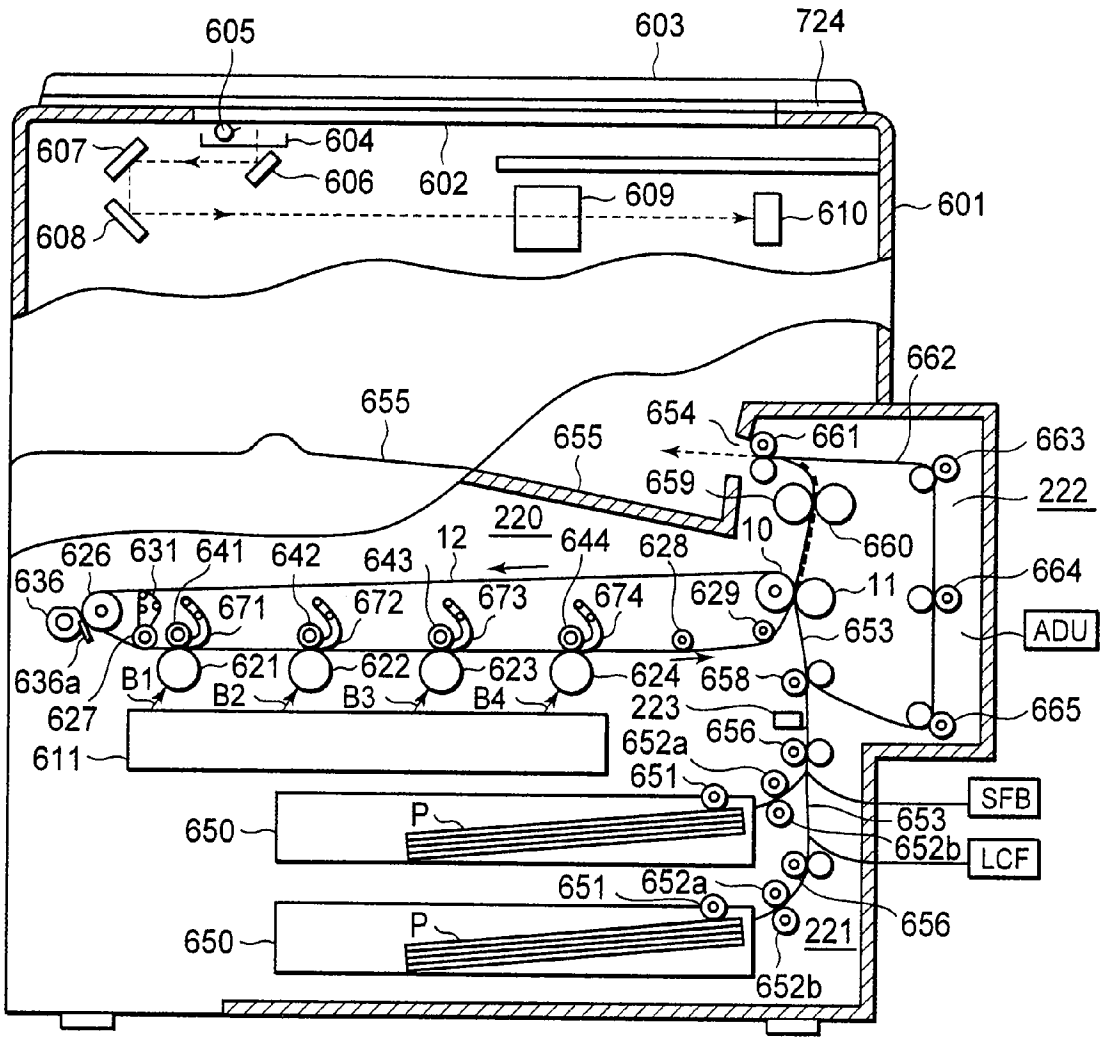
FIG. 10 is a diagram showing a configuration example of an image forming apparatus.

FIG. 10 is a diagram showing a configuration example of the image forming apparatus. As shown in FIG. 10, an original stand 602 for placing an original formed of a transparent material such as a glass plate is provided in an upper part of an apparatus main body 601. A cover 603 is openably and closably set in the apparatus main body 601 to cover the original stand 602.

A scan unit (not shown) that optically scans an image of an original placed on the original stand 602 is provided on a lower surface side of the original stand 602 in the inside of the apparatus main body 601. For example, the scan unit includes a carriage 604, reflection mirrors 606, 607, and 608 that reflect light of an exposure lamp 605 reflected on the original, a magnification lens block 609 that magnifies the reflected light, and a CCD (Charge Coupled Device) 610. The carriage 604 includes the exposure lamp 605 that irradiates light toward the original stand 602. The carriage 604 is configured to be reciprocatingly movable along the lower surface of the original stand 602.

The carriage 604 reciprocatingly moves while lighting the exposure lamp 605 to thereby expose the original placed on the original stand 602 to light. A reflected light image of the original, which is placed on the original stand 602, formed by this exposure is projected on the CCD 610 through the reflection mirrors 606, 607, and 608 and the magnification lens block 609. The CCD 610 outputs image data corresponding to the reflected light image of the original projected thereon.

An image forming unit 220 is provided below the scan unit in the inside of the apparatus main body 601. The image forming unit 220 includes, for example, a print engine (not shown) and a process unit (not shown).

The print engine includes an exposing unit 611. The process unit includes photoconductive drums 621, 622, 623, and 624 arranged along the exposing unit 611.

The process unit includes an endless transfer belt 12 arranged to be opposed to the exposing unit 611 across the photoconductive drums 621, 622, 623, and 624.

The process unit further includes a drive roller 626 that drives the transfer belt 12 and primary transfer rollers 641, 642, 643, and 644 arranged to be opposed to the photoconductive drums 621, 622, 623, and 624, respectively, across the transfer belt 12.

Furthermore, the process unit includes a transfer-roller driving unit that drives the primary transfer rollers 641, 642, 643, and 644.

The transfer belt 12 is laid over the driver roller 626, guide rollers 627, 628, and 629, and a driven roller 10. The transfer belt 12 receives power from the drive roller 626 and rotationally travels in the counterclockwise direction. The guide roller 627 is provided to freely move up and down. The guide roller 627 receives pivoting force of a cam 631 and moves to the transfer belt 12 side. Consequently, the guide roller 627 changes a position of the transfer belt 12 to the photoconductive drums 621, 622, 623, and 624 side.

The image forming unit 220 forms an image based on image data (an image signal outputted from the CCD 610) and executes an image forming process to print the image on a recording medium being conveyed. The image signal outputted from the CCD 610 is appropriately processed and, then, supplied to the exposing unit 611.

The exposing unit 611 emits a laser beam B1 corresponding to an image signal of yellow to the photoconductive drum 621 for yellow. The exposing unit 611 emits a laser beam B2 corresponding to an image signal of magenta to the photoconductive drum 622 for magenta. The exposing unit 611 emits a laser beam B3 corresponding to an image signal of cyan to the photoconductive drum 623 for cyan. The exposing unit 611 emits a laser beam B4 corresponding to an image signal of black to the photoconductive drum 624 for black.

The primary transfer rollers 641, 642, 643, and 644 are moved (lowered) to the transfer belt 12 side to thereby bring the transfer belt 12 into contact with the photoconductive drums 621, 622, 623, and 624 and transfer visible images on the photoconductive drums 621, 622, 623, and 624 onto the transfer belt 12.

A drum cleaner, a charge removing lamp, a charging unit, and a developing unit are sequentially disposed around the photoconductive drum 621. The drum cleaner has a drum cleaning blade in contact with the surface of the photoconductive drum 621 and scrapes off a developer remaining on the surface of the photoconductive drum 621 using the drum cleaning blade.

The charge removing lamp removes electric charge remaining on the surface of the photoconductive drum 621. The charging unit applies high voltage to the photoconductive drum 621 to thereby charge the surface of the photoconductive drum 621 with electrostatic charge. The laser beam B1 emitted from the exposing unit 611 is irradiated on the surface of the photoconductive drum 621 subjected to the charging. An electrostatic latent image is formed on the surface of the photoconductive drum 621 by the irradiation of the laser beam B1. The developing unit supplies a developer (a toner) of yellow to the surface of the photoconductive drum 621 to thereby visualize the electrostatic latent image on the surface of the photoconductive drum 621.

In the same manner, the other photoconductive drums 622, 623, and 624 visualize electrostatic latent images on the surfaces of the photoconductive drums 622, 623, and 624 using developers of colors corresponding to the photoconductive drums.

A cleaner 636 is provided, across the transfer belt 12, in a position of the image forming unit 220 opposed to the drive roller 626. The cleaner 636 has a cleaning blade 636*a* in contact with the transfer belt 12 and scrapes off a developer remaining on the transfer belt 12 using the cleaning blade 636*a*.

Printing modes are changed as described below. Hooks 671, 672, 673, and 674 are provided near the primary transfer rollers 641, 642, 643, and 644. The hooks 671, 672, 673, and 674 engage with shafts of the primary transfer rollers 641, 642, 643, and 644 and lift the shaft while pivoting and move the primary transfer rollers 641, 642, 643, and 644 in a direction separating from the photoconductive drums 621, 622, 623, and 624. Printing modes such as a full-color mode, a totally separated mode, and a monochrome mode are changed by moving none of the primary transfer rollers 641, 642, 643, and 644 or changing a combination of the primary transfer rollers to be moved.

A storing mechanism and a feeding mechanism for recording media are explained. Plural recording media cassettes 650 that store recording media are provided below the exposing unit 611. A large number of recording media P of types different from one another are stored in a stacked state in the recording media cassettes 650. Recording-media feeding mechanisms 221 for feeding the recording media in the recording media cassettes 650 one by one from the top are provided in outlet sections (on the right side in the figure) of the recording media cassettes 650, respectively. The recording media P are extracted one by one from any one of the recording media cassettes 650 by any one of the recording-media feeding mechanisms 221. The recording-media feeding mechanism 221 for extracting the recording media P includes a pickup roller 651, a recording-media feeding roller 652*a*, and a separation roller 652*b*. The recording-media feeding mechanism 221 separates the recording media P extracted from the recording media cassette 650 one by one and feeds the recording media P to a recording-media conveying path 653.

A conveying path for recording media is explained. The recording-media conveying path 653 extends to a recording-media discharge port 654 in an upper part through the driven roller 10 of the image forming unit 220. The recording-media discharge port 654 faces a recording-media discharging section 655 that continues to an outer peripheral surface of an apparatus main body 601. On a start end side of the conveying path 653, conveying rollers 656 are provided near the recording-media feeding mechanisms 221, respectively. When a recording medium is fed to the recording-media conveying path 653 by any one of the recording-media feeding mechanisms 221, the fed recording medium is conveyed to the recording-media discharging section 655 through the recording-media conveying path 653.

The secondary transfer roller 11 is provided in a position opposed to the driven roller 10, which is provided along the recording-media conveying path 653, across the transfer belt 12. Registration rollers 658 are provided in a position before the driven roller 10 and the secondary transfer roller 11 in a conveying direction.

The registration rollers 658 deliver the recording medium P into between the transfer belt 12 and the secondary transfer roller 11 at timing that synchronizes with a transfer operation, which is an operation for transferring an image formed with the developer (the toner) onto a recording medium, by the transfer belt 12 and the secondary transfer roller 11. The secondary transfer roller 11 transfers, while nipping the recording medium P delivered from the registration rollers 658 between the secondary transfer roller 11 and the transfer belt 12 on the driven roller 10, a visible image formed with the developer (the toner), which is transferred onto the transfer belt 12, onto the recording medium P and prints the visible image. In this way, the registration rollers 658 conveys the recording medium P to the image forming unit 220 having the transfer belt 12 and the secondary transfer roller 11 in synchronization with the transfer operation of the image forming unit 220.

A heat roller 659 for heat fixing and a press-contact roller 660 in contact with the heat roller 659 are provided in a position further on a downstream side than the secondary transfer roller 11 of the recording-media conveying path 653. The image transferred onto the recording medium P is fixed by the heat roller 659 and the press-contact roller 660. Recording-media discharging rollers 661 are provided at a terminal end of the recording-media conveying path 653.

An automatic duplex unit (hereinafter referred to as ADU) 222 may be provided in the apparatus main body 601. The ADU 222 is set to couple a sub-conveying path 662, which is a path for conveying the recording medium P in the ADU 222, to the terminal end of the recording-media conveying path 653 and an inlet to the registration rollers 658. The sub-conveying path 662 branches from a downstream side of the recording-media conveying path 653 with respect to the image forming unit 220 (the terminal end of the recording-media conveying path 653) and merges with an upstream side of the recording-media conveying path 653 with respect to the image forming unit 220 (an upstream side position of the registration rollers 658).

The sub-conveying path 662 reverses the front and the back of the recording medium P for duplex printing. Recording-media feeding rollers 663, 664, and 665 are provided in the sub-conveying path 662. The ADU 222 feeds backward the recording medium P, which is conveyed from the image forming unit 220 to the recording-media discharging section 655, conveys the recording medium P through the sub-conveying path 662, and merges the recording medium P into the recording-media conveying path 653 on an upstream side of the image forming unit 220. When the recording medium P is conveyed in this way, the front and the back of the recording medium P are reversed.

The recording medium P returning to the upstream side of the image forming unit 220 through the sub-conveying path 662 merges into the recording-media conveying path 653. Then, in synchronization with the transfer operation of the image forming unit 220, the recording medium P is delivered by the registration rollers 658 to a transfer position where the transfer belt 12 and the secondary transfer roller 11 are in contact with each other. In this way, the visible image on the transfer belt 112 is also transferred onto the rear surface of the recording medium P and printed thereon.

When duplex printing is designated from an operation panel 724 provided in the apparatus main body 601, a computer connected to the apparatus main body 601 through a network, or the like, the sub-conveying path 662 of the ADU 222 comes into a state for performing the operation for reversing the front and the back of the recording medium P.

Devices additionally provided in the apparatus main body are explained. In the example of the apparatus main body 601 shown in FIG. 10, two recording media cassettes 650 are provided as supply sources of recording media. Three or more recording media cassettes 650 may be provided in the apparatus main body 601. Besides, it is also possible to provide, although not shown in the figure, a manual recording-media feeding mechanism (hereinafter referred to as SFB) or a large-capacity recording media feeder (hereinafter referred to as LCF), which is a recording-media feeding mechanism in which several thousands recording media can be stacked and stored. The SFB or the LCF is set in the apparatus main body 601 such that a path for feeding recording media from the SFB or the LCF merges with the recording-media conveying path 653.

A recording media type sensor 223 may be provided in the apparatus main body 601. The recording media type sensor 223 is arranged in a position on an upstream side of the recording-media conveying path 653 with respect to the image forming unit 220 and further on an upstream side than the registration rollers 658. The recording media type sensor 223 detects a recording media type of the recording medium P conveyed through the recording-media conveying path 653. As the recording media type sensor 223, for example, a publicly-known sensor that determines a type of the recording medium P by detecting the thickness and the light transmittance of the recording medium P can be used.

When the SFB or the LCF is set, the recording media type sensor 223 is arranged further on a downstream side than a merging point of the recording-media feeding path from the SFB or the LCF and the recording-media conveying path 653. By arranging the recording media type sensor 223 in this way, it is possible to detect types of the recording media P conveyed on the recording-media conveying path 653 from all the supply sources of recording media using one recording media type sensor 223.

Waste-Developer Carrying Mechanisms

Explanation of a Configuration

Figure 1:
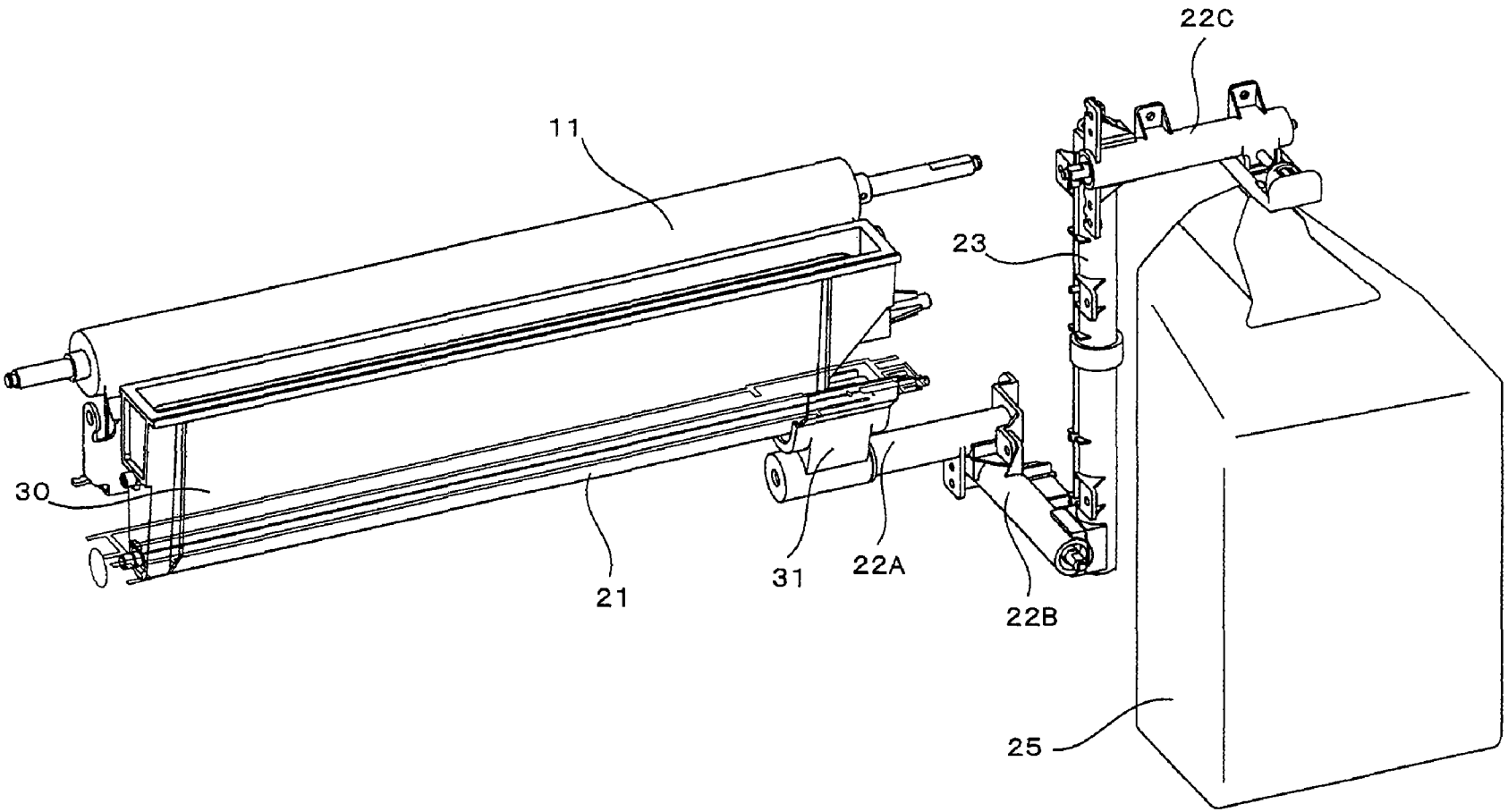
FIG. 1 is a perspective view showing waste-developer carrying mechanisms.

FIG. 1 is a perspective view showing waste-developer carrying mechanisms. As shown in FIG. 1, the image forming apparatus includes a collection case 30 for collecting a waste developer scraped off from the secondary transfer roller 11, a horizontal carrying mechanism 21 that is set in a lower part of the collection case 30 and collects the waste developer in the horizontal direction, relay carrying mechanisms 22A and 22B that carry the waste developer collected by the horizontal carrying mechanism 21 to a desired position, a vertical carrying mechanism 23 that carries the waste developer, which is carried by the relay carrying mechanisms 22A and 22B, in the vertical upward direction, and a relay carrying mechanism 22C that feeds the waste developer carried by the vertical carrying mechanism 23 into a storage case 25.

The relay carrying mechanism 22A is connected to an end section in a waste developer carrying direction of the horizontal carrying mechanism 21 via a pivoting duct 31. The relay carrying mechanism 22B is connected to the relay carrying mechanism 22A at one end and connected to the vertical carrying mechanism 23 at the other end. The vertical carrying mechanism 23 is connected to the relay carrying mechanism 22B at one end and connected to the relay carrying mechanism 22C at the other end.

A part or all of the relay carrying mechanisms 22A, 22B, and 22C can be omitted or a relay carrying mechanism can be further added depending on an arrangement of the storage case 25. By configuring the waste-developer carrying mechanisms in this way, it is possible to carry the waste developer to the storage case 25 arranged in an arbitrary position.

In particular, the vertical carrying mechanism 23 can be configured to carry the waste developer to the storage case 25 having an opening in a position higher than the horizontal carrying mechanism 21. By configuring the vertical carrying mechanism 23 in this way, there is an effect that a degree of freedom is given to a layout of the storage case 25.

Figure 2:
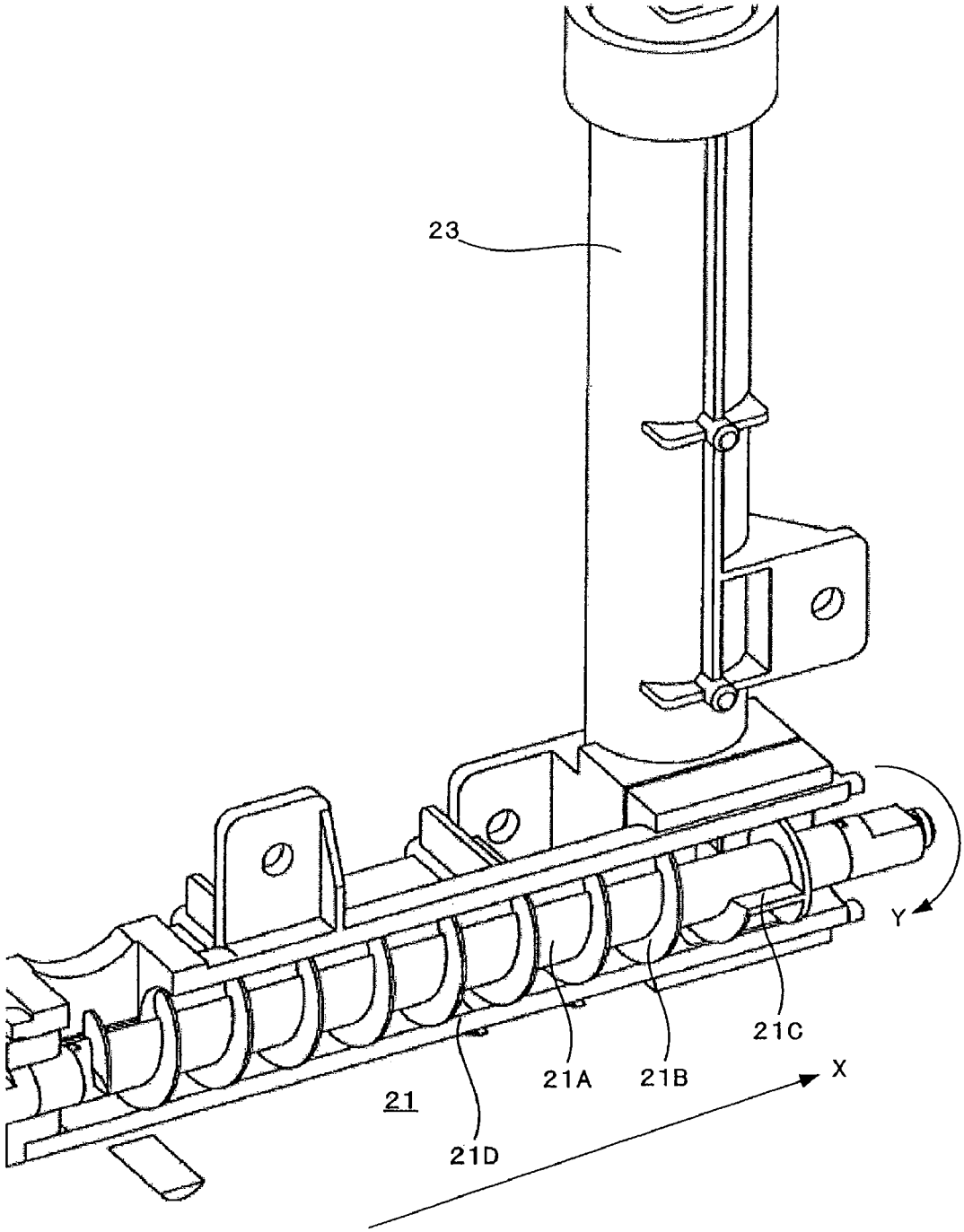
FIG. 2 is a sectional view showing the inside of an end section of a horizontal carrying mechanism 21.

FIG. 2 is a sectional view showing the inside of the end section of the horizontal carrying mechanism 21. As shown in FIG. 2, the horizontal carrying mechanism 21 can be configured to carry the waste developer using an auger mechanism.

The auger mechanism refers to, as shown in FIG. 2, a mechanism in which a rotor 21A including spiral fins 21B is inserted through a cylindrical carrying tube 21D and, when the rotor 21A is rotated, the fins 21B are rotated to carry a carrying object in a fixed direction.

In FIG. 2, the rotor 21A rotates in a direction of an arrow Y to thereby carry the carrying object in a direction of an arrow X. The waste developer as the carrying object is accumulated among the fins 21B by the gravity. The fins 21B rotating in the arrow Y direction drive the waste developer in the arrow X direction. The auger mechanism carries the waste developer to an end in the arrow X direction by continuously repeating this operation.

The horizontal carrying mechanism 21 has a push-out rib 21C at a terminal end in the carrying direction of the fins 21B. The push-out rib 21C is parallel to a waste developer carrying direction, i.e., a rotating shaft direction of the rotor 21A. The push-out rib 21C pushes out the carried waste developer vertically with respect to the rotating shaft of the rotor 21A.

By configuring the horizontal carrying mechanism 21 in this way, it is possible to surely push out the carried waste developer to the vertical carrying mechanism 23 and prevent the waste developer from being held up in the end section of the horizontal carrying mechanism 21.

The auger mechanism can also be adopted in the vertical carrying mechanism 23 and the relay carrying mechanisms 22A, 22B, and 22C.

The vertical carrying mechanism 23 and the relay carrying mechanisms 22A, 22B, and 22C are generally referred to as waste-developer carrying mechanisms.

As explained above, the image forming apparatus according to this embodiment has the vertical carrying mechanism 23 for carrying the waste developer vertically upward. This increases a degree of freedom of layout of the storage case 25 and makes it possible to realize space-saving. Therefore, there is an effect that it is possible to set a larger storage case 25.

Flow rates of the respective waste-developer carrying mechanisms

Figure 3:
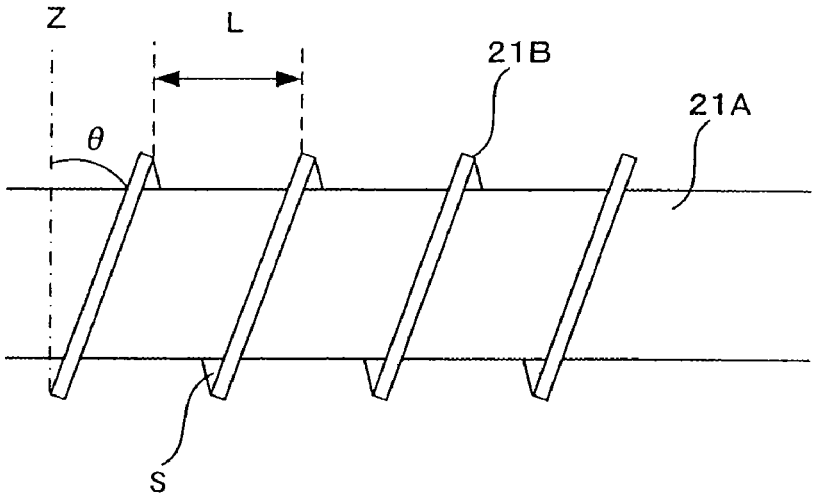
FIG. 3 is a side view of fins 21B of an auger mechanism.

FIG. 3 is a side view of the fins 21B of the auger mechanism. A pitch L represents a distance between the tip of a certain fin 21B and the tip of an adjacent fin 21B. A surface area S represents a surface area per one cycle of the fins 21B. Rotating speed r represents rotation angular speed of the rotor 21A. LSr represents a waste developer flow rate. In other words, the waste developer flow rate is the volume of a carried waste developer per unit time.

A pitch of the horizontal carrying mechanism 21 is represented as $L_1$, a surface area thereof is represented as $S_1$, and rotating speed thereof is represented as $r_1$. Concerning the waste-developer carrying mechanisms at post stages of the horizontal carrying mechanism 21, pitches are represented as $L_2$, $L_3$, . . . , and $L_n$, surface areas are represented as $S_2$, $S_3$, . . . , and $S_n$, and rotating speeds are represented as $r_2$, $r_3$, . . . , and $r_n$. Here, n is an integer.

The image forming apparatus according to this embodiment is configured such that a relation of the following formula (1) holds:

$$L_1S_1r_2 \leqq L_2S_2r_2 \leqq L_3S_3r_3 \ldots \leqq L_nS_nr_n \quad (1)$$

In other words, a waste developer flow rate of the waste-developer carrying mechanism at a post stage is equal to or larger than a waste developer flow rate of the waste-developer carrying mechanism at a pre-stage thereof.

The fins 21B form an angle θ with respect to a straight line Z perpendicular to the rotating shaft of the rotor 21A. The angle θ is desirably equal to or larger than 3° and equal to or smaller than 80°. When the angle θ is smaller than 3°, sufficient carrying force cannot be obtained. When the angle θ exceeds 80°, the fins 21B are clogged with the waste developer.

Figure 4:
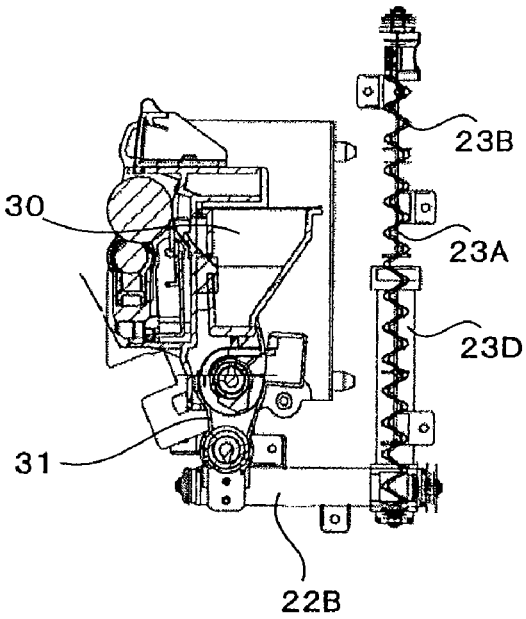
FIG. 4 is a perspective view showing the inside of a vertical carrying mechanism 23.

FIG. 4 is a perspective view showing the inside of the vertical carrying mechanism 23. As shown in FIG. 4, the image forming apparatus includes the collection case 30 for collecting a waste developer scraped off from the secondary transfer roller 11, the horizontal carrying mechanism 21 that is set in a lower part of the collection case 30 and collects the waste developer in the horizontal direction, the relay carrying mechanisms 22A and 22B that carry the waste developer collected by the horizontal carrying mechanism 21 to a desired position, and the vertical carrying mechanism 23 that carries the waste developer, which is carried by the relay carrying mechanisms 22A and 22B, in the vertical upward direction.

As shown in FIG. 4, the auger mechanism can also be adopted in the vertical carrying mechanism 23. The vertical carrying mechanism 23 is configured by inserting a rotor 23A including spiral fins 23B through the inside of a cylindrical carrying tube 23D.

As in the horizontal carrying mechanism 21 shown in FIG. 3, the fins 23B form an angle θ with respect to a straight line Z perpendicular to a rotating shaft of the rotor 23A. The angle θ is desirably equal to or larger than 3° and equal to or smaller than 80°. When the angle θ is smaller than 3°, sufficient carrying force cannot be obtained. When the angle θ exceeds 80°, the fins 23B are clogged with the waste developer.

When the rotor 23A is rotated, the fins 23B rotate to carry the waste developer upward. The vertical carrying mechanism 23 receives the waste developer at a lower end thereof. The rotor 23A rotates in a direction for pushing up the waste developer received by the fins 23B. Since the waste developer is continuously fed into the vertical carrying mechanism 23, the waste developer fed later sequentially pushes up the waste developer fed earlier. In this way, the vertical carrying mechanism 23 carries the waste developer to an upper end of the vertical carrying mechanism 23.

As described above, in the image forming apparatus according to this embodiment, a waste developer flow rate of the waste-developer carrying mechanism at a post stage is equal to or larger than a waste developer flow rate of the waste-developer carrying mechanism at a pre-stage thereof.

Therefore, there is an effect that the waste developer can be smoothly carried to the storage case without being held up.

Pivoting Duct

Figure 5:
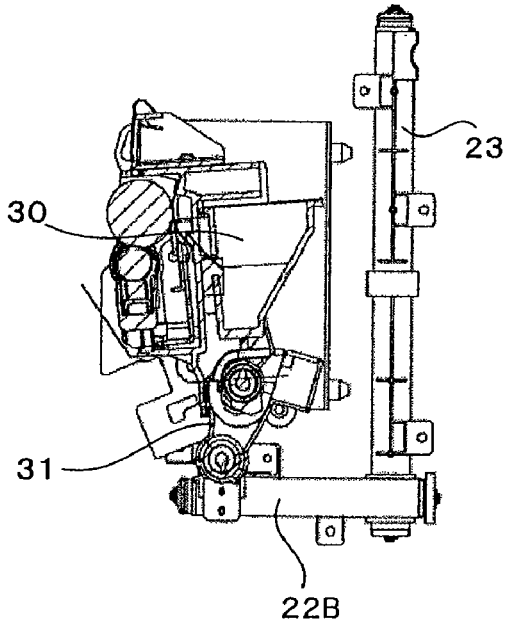
FIG. 5 is a side view showing a state in which a collection case 30 pivots.

FIG. 5 is a side view showing a state in which the collection case 30 pivots. As shown in FIG. 5, the image forming apparatus includes the collection case 30 for collecting a waste developer scraped off from the secondary transfer roller 11, the horizontal carrying mechanism 21 that is set in a lower part of the collection case 30 and collects the waste developer in the horizontal direction, the relay carrying mechanisms 22A and 22B that carry the waste developer collected by the horizontal carrying mechanism 21 to a desired position, and the vertical carrying mechanism 23 that carries the waste developer, which is carried by the relay carrying mechanisms 22A and 22B, in the vertical upward direction.

As shown in FIG. 5, when a paper jam is cleared or the image forming apparatus is repaired, the collection case 30 pivots around a rotation center axis in a position higher than the collection case 30. When the collection case 30 pivots, the horizontal carrying mechanism 21 provided in the lower part of the collection case 30 also pivots. The image forming apparatus according to this embodiment includes the pivoting duct 31 that pivots following the pivoting of the horizontal carrying mechanism 21.

Figure 6:
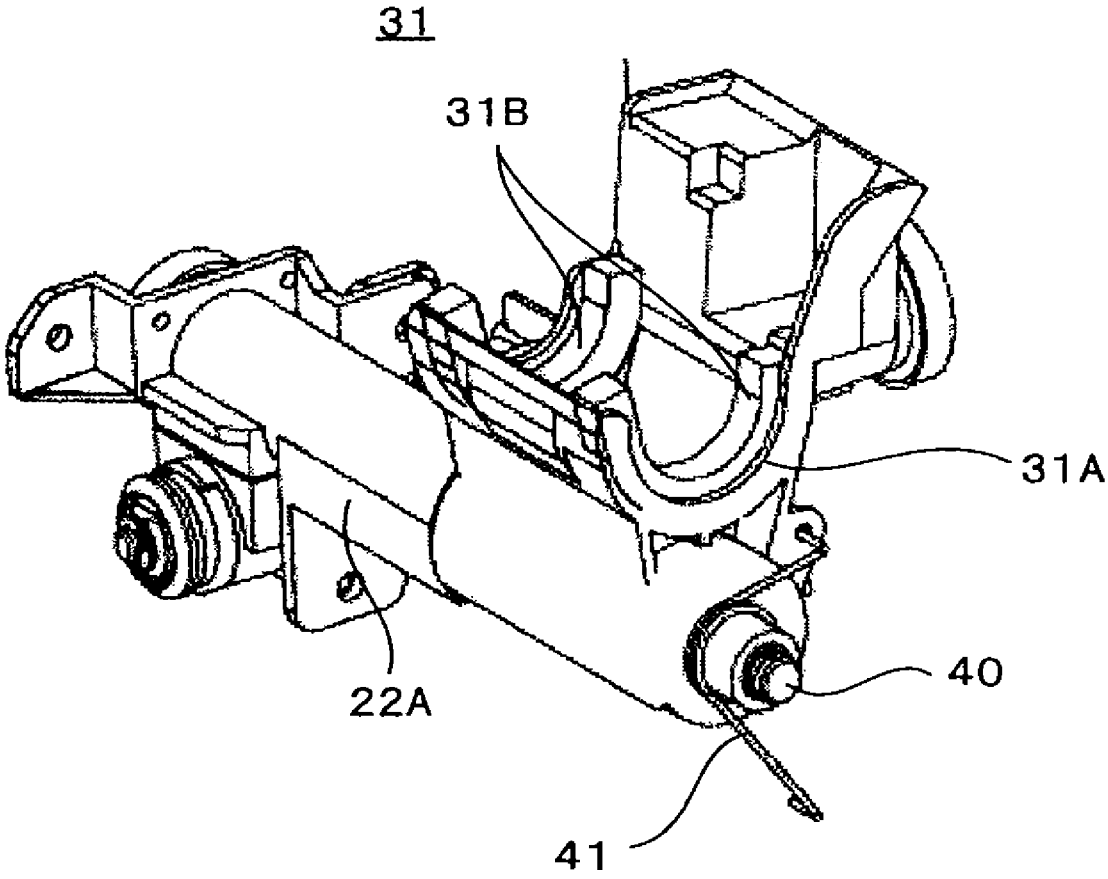
FIG. 6 is a perspective view of a pivoting duct 31.

FIG. 6 is a perspective view of the pivoting duct 31. As shown in FIG. 6, the pivoting duct 31 includes a bearing unit 31A cut out in a U shape and connected to the end of the horizontal carrying mechanism 21 and seals 31B of a U shape provided on inner sides of the bearing unit 31A. The pivoting duct 31 also includes a spring 41 that urges the pivoting duct 31 in a reverse pivoting direction.

The pivoting duct 31 is pivotally attached to one end of the relay carrying mechanism 22A to pivot around a rotating shaft 40 of the rotor of the auger mechanism. The pivoting duct 31 receives, through an opening thereof, the waste developer carried by the horizontal carrying mechanism 21 and passes the waste developer to the relay carrying mechanism 22A, which is the waste-developer carrying mechanism at the next stage.

Therefore, the pivoting duct 31 is generally formed in a shape obtained by attaching an upward-widening truncated pyramid to a side of a tube of a substantially cylindrical shape attached to the relay carrying mechanism 22A. Specifically, the pivoting duct 31 is formed in a shape obtained by removing the upper base of the truncated pyramid and providing the bearing unit 31A cut out in a U shape on the side thereof. The truncated pyramid may include a curved surface.

When the horizontal carrying mechanism 21 pivots, the pivoting duct 31 pivots around the rotating shaft 40 following the pivoting of the horizontal carrying mechanism 21. When the horizontal carrying mechanism 21 returns to the original position, the pivoting duct 31 also returns to the original position with the urging force of the spring 41.

When the collection case 30 pivots, the horizontal carrying mechanism 21 set in the lower part of the collection case 30 shifts from the pivoting duct 31. At this point, the seals 31B close a space between the horizontal carrying mechanism 21 and the pivoting duct 31 and prevent the waste developer from leaking out from the collection case 30.

In this way, the seals 31B have width larger than the shift of the horizontal carrying mechanism 21 from the pivoting duct 31.

Figure 7:
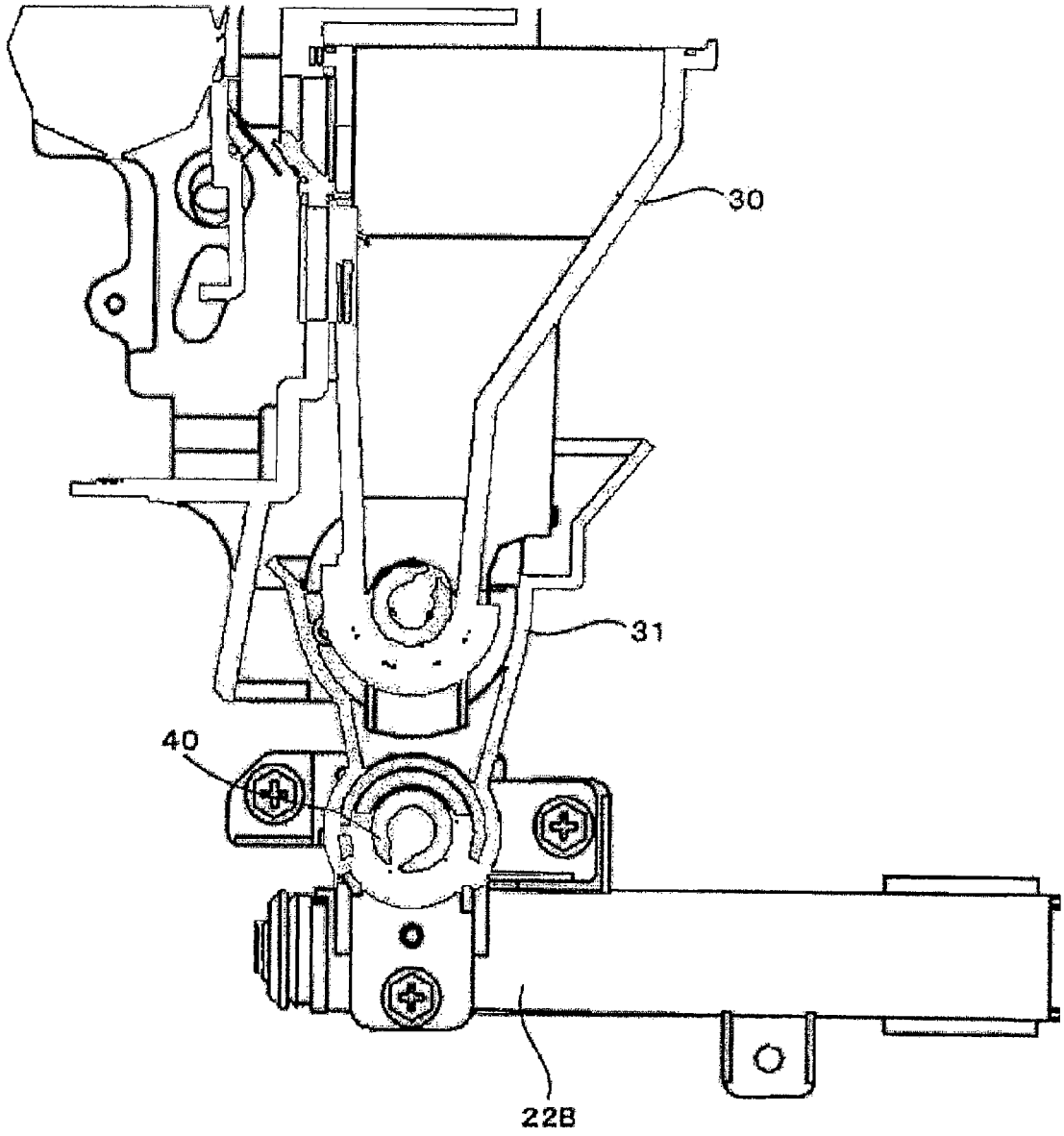
FIG. 7 is a side view showing a state before the collection case 30 pivots.
Figure 8:
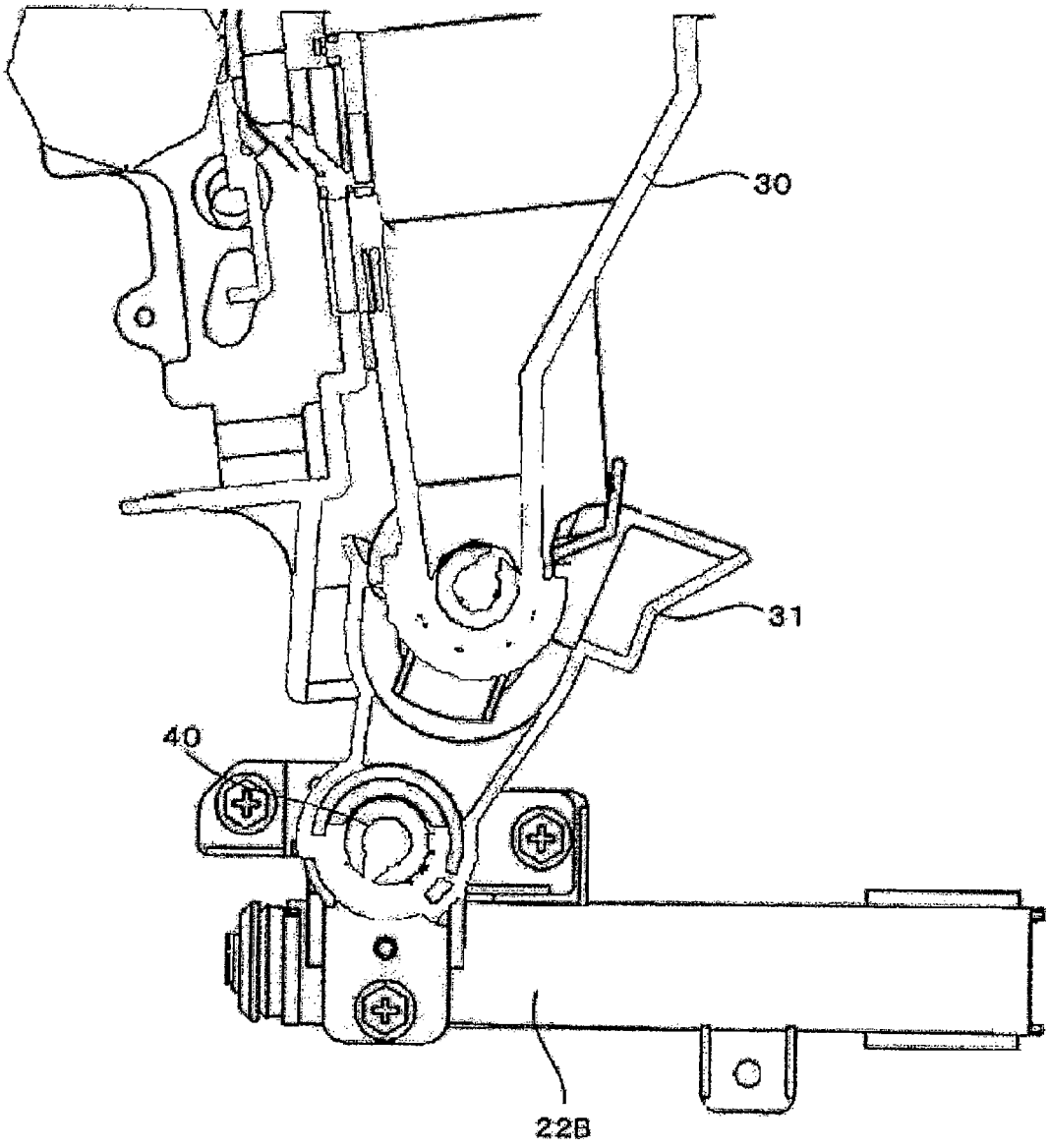
FIG. 8 is a side view showing a state in which the collection case 30 pivots.

FIG. 7 is a side view showing a state before the horizontal carrying mechanism 21 pivots. FIG. 8 is a side view showing a state in which the horizontal carrying mechanism 21 pivots. As shown in FIGS. 7 and 8, when the horizontal carrying mechanism 21 pivots, the pivoting duct 31 pivots following the pivoting of the horizontal carrying mechanism 21. In this case, even if the horizontal carrying mechanism 21 shifts from the pivoting duct 31, the horizontal carrying mechanism 21 does not come off from the pivoting duct 31. The pivoting duct 31 slides and grips the horizontal carrying mechanism 21. The waste developer does not leak.

Figure 9:
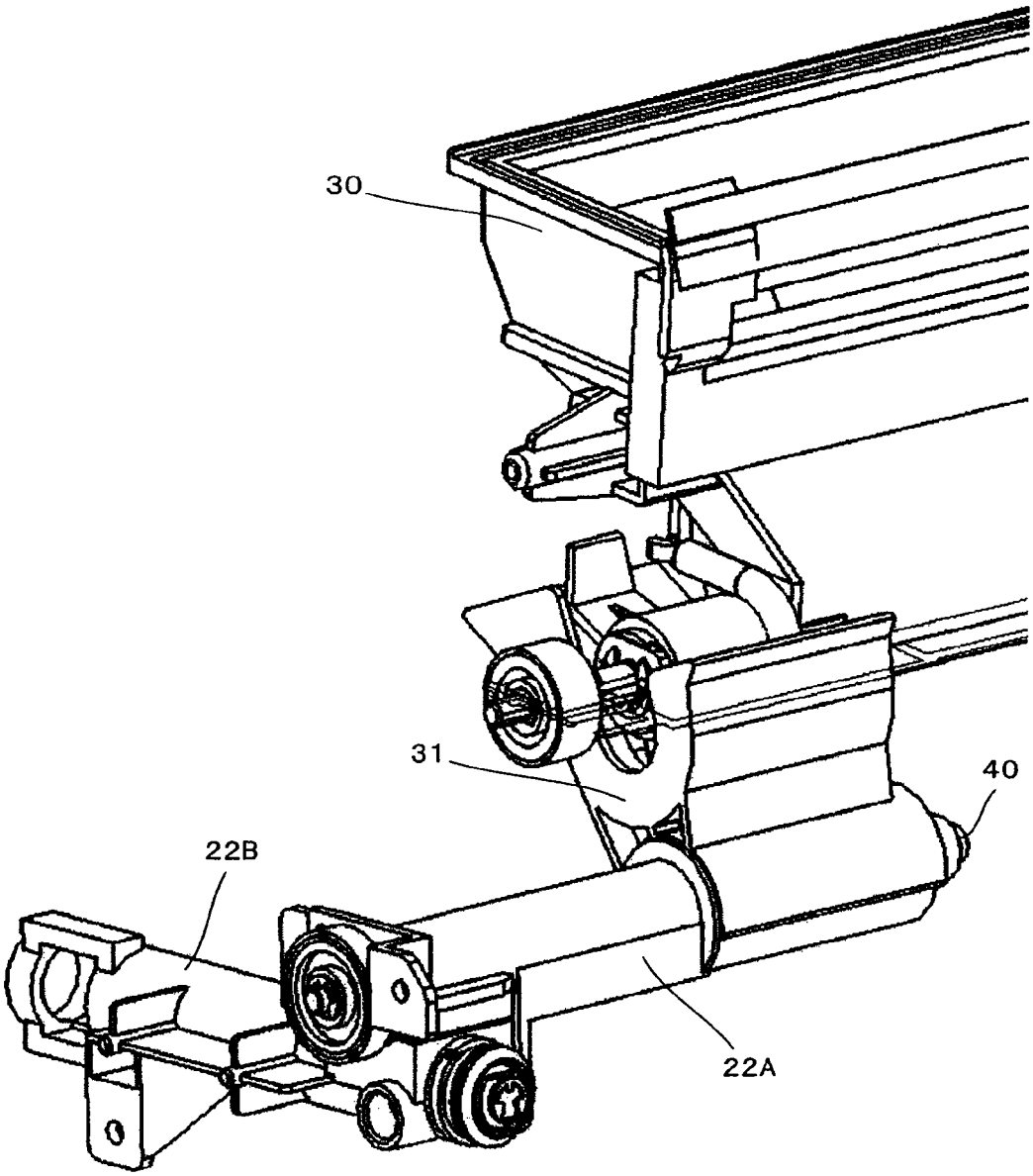
FIG. 9 is a perspective view showing a state in which the collection case 30 is removed from the pivoting duct 31.

FIG. 9 is a perspective view showing a state in which the collection case 30 is removed from the pivoting duct 31. As shown in FIG. 9, since the pivoting duct 31 has the bearing unit 31A cut out in a U shape, it is possible to easily remove the collection case 30.

As explained above, the image forming apparatus according to this embodiment includes the pivoting duct 31 that pivots following the pivoting of the collection case 30. Therefore, there is an effect that it is possible to set an area of the opening of the horizontal carrying mechanism 2 smaller than that in the related art and realize space-saving. There is also an effect that it is unnecessary to set an elastic member for urging a seal material, which was necessary in the past.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An image forming apparatus comprising:

a recording-medium feeding mechanism that feeds recording medium one by one;

a recording-medium conveying path to convey the recording medium fed by the recording-medium feeding mechanism to a recording-medium discharge section;

an image forming unit that is arranged further on an upstream side than the recording-medium discharge section of the recording-medium conveying path and executes an image forming process to print an image based on image data on the recording medium conveyed through the recording-medium conveying path;

a first carrying mechanism that receives a waste developer collected from a secondary transfer roller of the image forming unit and carries the waste developer to one end thereof;

a second carrying mechanism that receives the waste developer carried by the first carrying mechanism and carries the waste developer in a vertical upward direction to a position higher than the first carrying mechanism; and a pivoting duct that receives the waste developer carried by the first carrying mechanism and passes the waste developer to a waste developer carrying mechanism at a next stage.

2. The apparatus according to claim 1, wherein a waste developer flow rate of the second carrying mechanism is equal to or larger than a waste developer flow rate of the first carrying mechanism.

3. The apparatus according to claim 1, further comprising a relay carrying mechanism that relays and carries the waste developer, the relay carrying mechanism being provided between a storage case that stores the waste developer carried by the second carrying mechanism and the first carrying mechanism, wherein a waste developer flow rate of a waste-developer carrying mechanism at a post stage is equal to or larger than a waste developer flow rate of a waste-developer carrying mechanism at a pre-stage thereof.

4. The apparatus according to claim 1, wherein the second carrying mechanism includes an auger mechanism.

5. The apparatus according to claim 4, wherein fins of the auger mechanism form an angle equal to or larger than 3 degrees and equal to or smaller than 80 degrees with respect to a straight line perpendicular to a rotating shaft of a rotor of the auger mechanism.

6. The apparatus according to claim 1, wherein the first carrying mechanism includes an auger mechanism.

7. The apparatus according to claim 1, wherein the first carrying mechanism includes an auger mechanism that has, at an end thereof in a carrying direction of the waste developer, a push-out rib parallel to the carrying direction of the waste developer.

8. The apparatus according to claim 1, wherein the pivoting duct pivots following pivoting of the first carrying mechanism.

9. The apparatus according to claim 1, wherein the pivoting duct is pivotally set in the waste-developer carrying mechanism at the next stage.

10. The apparatus according to claim 1, wherein the pivoting duct includes:

a bearing unit cut out in a U shape, the bearing unit being connected to an end of the first carrying mechanism; and seals of a U shape provided on inner sides of the bearing unit.

11. The apparatus according to claim 1, wherein the pivoting duct includes:

a bearing unit cut out in a U shape, the bearing unit being connected to an end of the first carrying mechanism; and seals of a U shape provided on inner sides of the bearing unit, the seals having width larger than shift of the first carrying mechanism from the pivoting duct.

12. The apparatus according to claim 1, wherein the pivoting duct includes a spring that urges the pivoting duct in a reverse pivoting direction.

13. The apparatus according to claim 1, wherein the second carrying mechanism carries the waste developer to a position equal to or higher than an opening of a storage case that stores the waste developer, an opening of the storage case being located in a position higher than the first carrying mechanism.

14. The apparatus according to claim 1, wherein the second carrying mechanism directly feeds the waste developer into a storage case that stores the waste developer.

15. The apparatus according to claim 1, wherein second carrying mechanism changes a carrying direction of the waste developer from a carrying direction in a horizontal direction by the first carrying mechanism to a carrying direction in a vertical direction.

16. A waste developer collecting method for an image forming apparatus, comprising:

receiving a waste developer collected from a image forming unit by a first carrying mechanism with a pivoting duct configured to follow a pivoting of the first carrying mechanism;

carrying the waste developer to one end of the first carrying mechanism; and carrying the waste developer in a vertical upward direction to a storage case having an opening in a position higher than the first carrying mechanism by a second carrying mechanism.

17. The method according to claim 16, wherein the second carrying mechanism carries the waste developer at a waste developer flow rate equal to or larger than a waste developer flow rate of the first carrying mechanism.

18. The method according to claim 16, further comprising pushing out the carried waste developer vertically with respect to a rotating shaft of a rotor of the first carrying mechanism with a push-out rib.

19. The method according to claim 16, further comprising carrying the waste developer carried by the first carrying mechanism to a storage case set in a desired position using the second carrying mechanism and plural waste-developer carrying mechanism.

20. The method according to claim 16, further comprising closing a space between the first carrying mechanism and the pivoting duct with seals included in the pivoting duct.

21. The method according to claim 16, further comprising changing a carrying direction of the waste developer from a horizontal direction to a vertical direction with the second carrying mechanism.

* * * * *